US007210676B1

(12) United States Patent
Blau

(10) Patent No.: US 7,210,676 B1
(45) Date of Patent: May 1, 2007

(54) CROWN MOLDING CLAMP

(76) Inventor: Karl T. Blau, 1808 NW. 77th Ave., Margate, FL (US) 33063

( * ) Notice: Subject to any disclaimer, the term of this patent is extended or adjusted under 35 U.S.C. 154(b) by 188 days.

(21) Appl. No.: 10/937,727

(22) Filed: Sep. 10, 2004

(51) Int. Cl.
*B25B 1/20* (2006.01)

(52) U.S. Cl. ..... 269/37; 269/907

(58) Field of Classification Search ..... 269/37, 269/95, 93, 904, 152, 153; 33/645, 542
See application file for complete search history.

(56) References Cited

U.S. PATENT DOCUMENTS

| | | | | |
|---|---|---|---|---|
| 4,930,221 | A * | 6/1990 | Taylor | 33/811 |
| 4,989,336 | A | 2/1991 | Waltrip, Jr. et al. | |
| 5,088,682 | A * | 2/1992 | Gibbs | 248/542 |
| 5,123,172 | A | 6/1992 | Thrun | |
| 5,573,228 | A | 11/1996 | Chestnut | |
| 5,611,189 | A * | 3/1997 | Fleck | 52/702 |
| 5,737,844 | A | 4/1998 | Brumley | |
| 5,855,073 | A | 1/1999 | Boelling | |
| 6,364,303 | B1 * | 4/2002 | Gustavson | 269/37 |
| 6,415,520 | B1 | 7/2002 | Locklear | |
| 6,532,674 | B2 | 3/2003 | Farese | |
| 6,820,868 | B1 * | 11/2004 | Reymus | 269/41 |

* cited by examiner

*Primary Examiner*—Lee D. Wilson
(74) *Attorney, Agent, or Firm*—Oltman, Flynn & Kubler

(57) ABSTRACT

A clamp for use in installing crown molding which has a top front lip, a bottom rear lip and a bridging segment extending diagonally between them, comprising a clamp part for engaging the ceiling of a room and for engaging the top front lip of the crown molding from in front, and another clamp part for engaging the bottom rear lip of the crown molding from below and engaging the room wall behind the crown molding.

7 Claims, 5 Drawing Sheets

CROWN MOLDING CLAMP

BACKGROUND OF THE INVENTION

1. Field of the Invention

This invention relates to a clamp to facilitate installing crown molding along the periphery of the ceiling of a room.

2. Prior Art

When crown molding is installed on the walls of a room at the ceiling, usually each piece of the molding is long and therefore somewhat flexible, preferably long enough to extend completely across the wall to which it is to be nailed, or substantially so. Because of its length the crown molding is difficult for one worker to handle without assistance as the nailing proceeds from one wall stud to the next across the wall.

SUMMARY OF THE INVENTION

The present invention is directed to a novel crown molding clamp which enables one worker, without assistance from another, to more readily affix long pieces of crown molding along the walls of a room at the ceiling. The present clamp is adjustable to fit crown molding of different sizes and configurations.

In the presently preferred embodiment, the clamp of the present invention has a fixed piece with a front wall for engaging the ceiling and for selective engagement with the top front lip of the crown molding from in front, as well as a bottom wall for engaging the bottom rear lip of the crown molding from below and for engaging the room wall behind the crown molding, and adjustable pieces behind the front wall of the fixed piece which are selectively adjustable to engage the ceiling and the top front lip of the crown molding, depending on the size of the crown molding.

A principal object of this invention is to provide a novel and advantageous clamp for use in installing crown molding on the walls of a room at the ceiling.

Another object of this invention is to provide such a clamp which is adjustable to fit different sizes of crown molding.

Further objects and advantages of this invention will be apparent from the following detailed description of two presently preferred embodiments thereof, with reference to the accompanying drawings.

DETAILED DESCRIPTION OF THE INVENTION

Before explaining the present invention in detail it is to be understood that the invention is not limited in its application to the particular arrangements shown and described since the invention is capable of other embodiments. Also, the terminology used herein is for the purpose of description and not of limitation.

Figure 1:
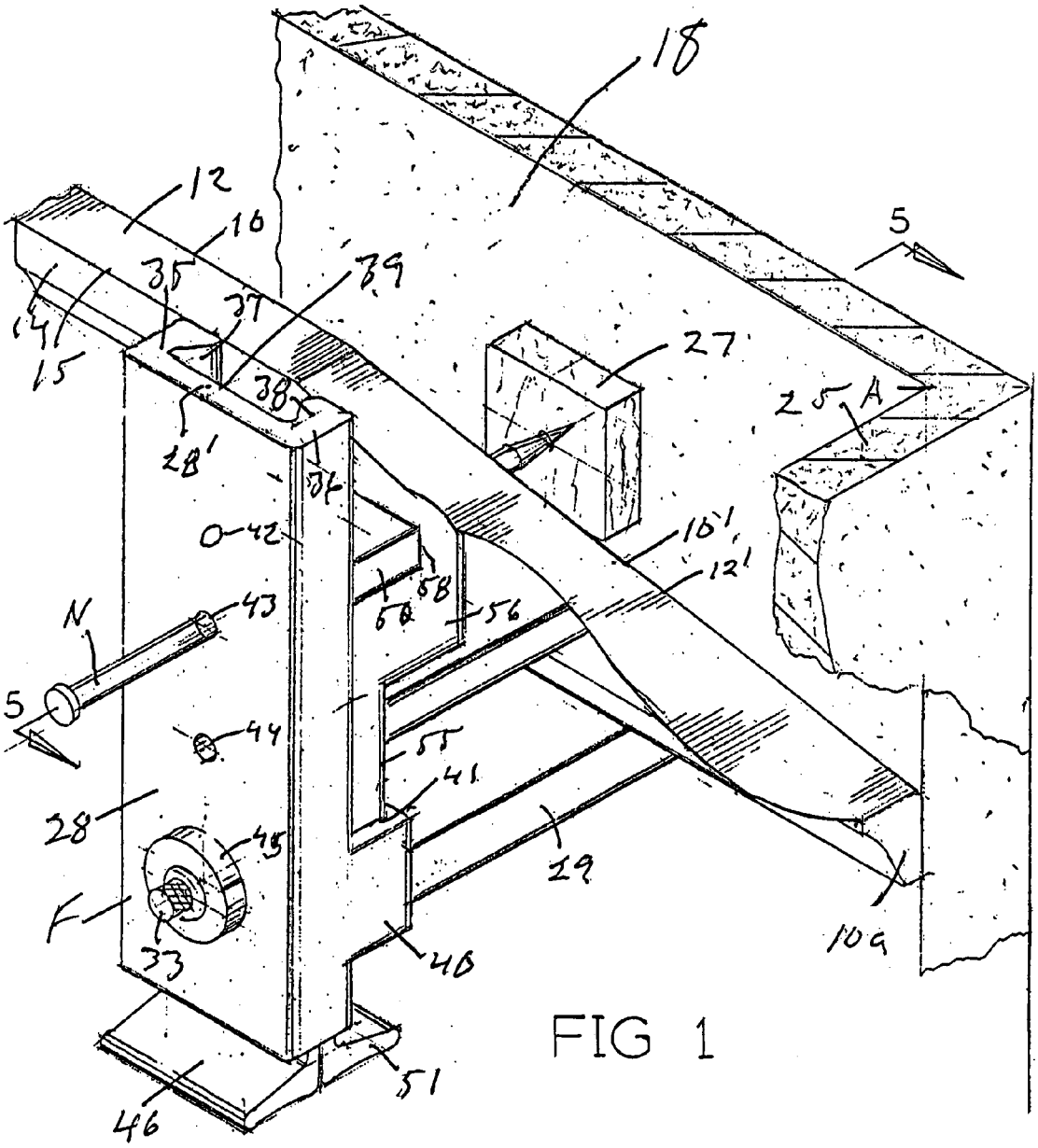
FIG. 1 is a perspective view of a clamp in accordance with a first embodiment of this invention holding one end of a long piece of crown molding in position to be nailed to a stud in the room wall just behind.

As shown in FIGS. 1–4, the first embodiment of the present clamp is adjusted for use in installing relatively large sized crown molding 10 which has a forwardly projecting, horizontal top lip 11 at the front (FIG. 5) with a flat horizontal top face 12 for engaging the ceiling 13 of the room except in the vicinity of a corner of the room at each end of the crown molding, such as the corner A in FIG. 1 at the right end of the crown molding where adjoining side walls 18 and 25 of the room meet. The top front lip 11 has a flat vertical front face 14 extending down from its top face 12 at a right-angled top front corner 15 (FIG. 1). The crown molding has an oppositely located, downwardly projecting, bottom lip 16 at the back which presents a flat vertical rear face 17 for engaging a wall 18 of the room which extends up to the ceiling 13, and a flat horizontal bottom face 19 extending forward from the rear face 17 and making a right-angled lower back corner 20 with it. The crown molding has a wide bridging segment 21 extending diagonally between its bottom rear lip 16 and its top front lip 11 and integral with both. The bridging segment has a flat back face 22 and a front face 23 of any suitable configuration to provide the appearance desired.

Figure 3:
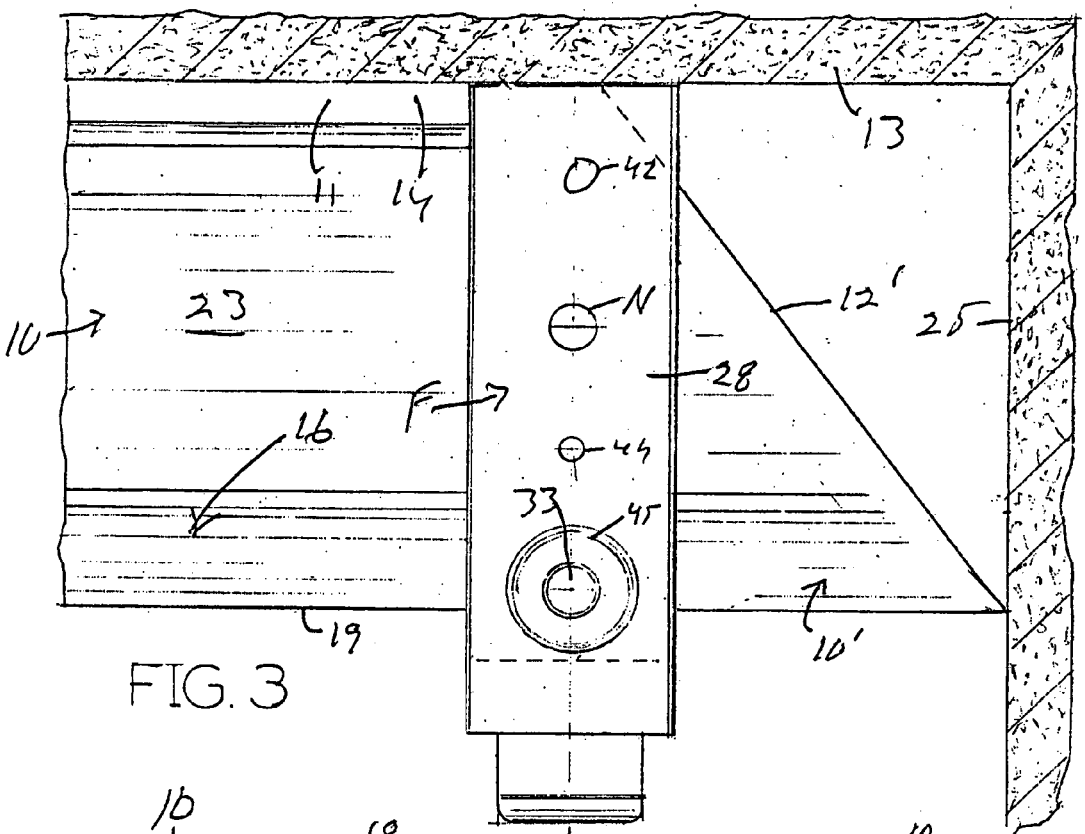
FIG. 3 is a front elevation of the clamp and crown molding shown in FIG. 1 with the crown molding against the ceiling and an adjoining wall of the room.
Figure 4:
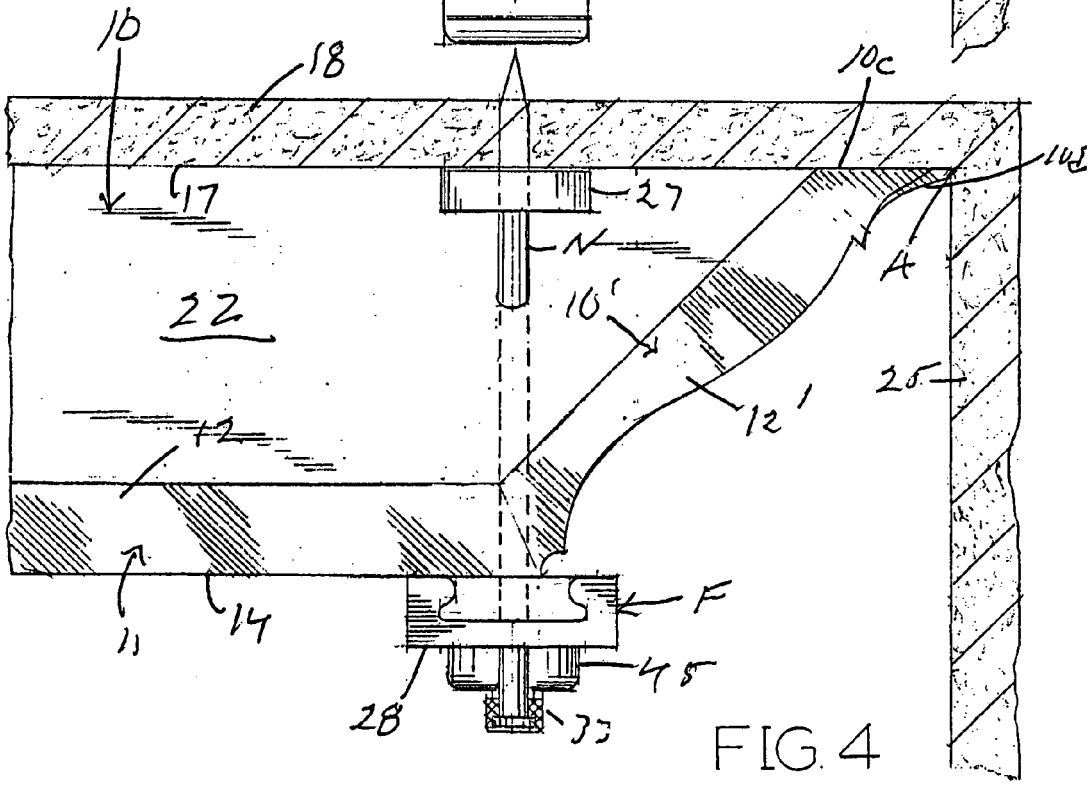
FIG. 4 is a top plan view of the FIG. 3 assembly, showing the room walls in cross-section.

At its right end in FIGS. 1, 3 and 4 the crown molding 10 presents a triangular end segment 10' (FIG. 3) which, as best seen in FIG. 4, inclines at a 45 degree angle rearward from the main body of the crown molding to the room corner A where room walls 18 and 25 intersect. This end segment 10*a* has a flat top face 12' (FIGS. 1 and 3) which inclines downward from the horizontal top face 12 of the main body of the crown molding to an end corner of the crown molding where it presents a relatively wide, flat, vertical rear face 10*c* (FIG. 4) for engaging the room wall 18 at the room corner A and a narrower, flat, vertical side face 10*d* (FIGS. 1 and 4) for engaging the adjoining room wall 25 at this corner of the room.

It is to be understood that the clamp of the present invention may be used with crown molding of conventional configuration lacking the triangular end segment shown in FIGS. 1, 3 and 4 and instead having a simple mitered end face to engage a similar mitered end face on the neighboring end of the crown molding on the adjoining room wall at that particular corner of the room.

Figure 10:
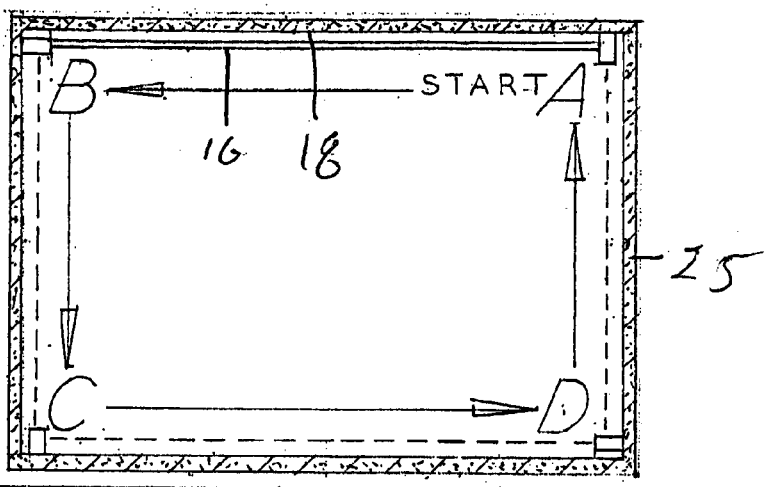
FIG. 10 is a horizontal cross-section showing the four wall of a room on which crown molding pieces are to be installed from corner to corner in the sequence indicated by the arrows, starting at corner A.
Figure 11:
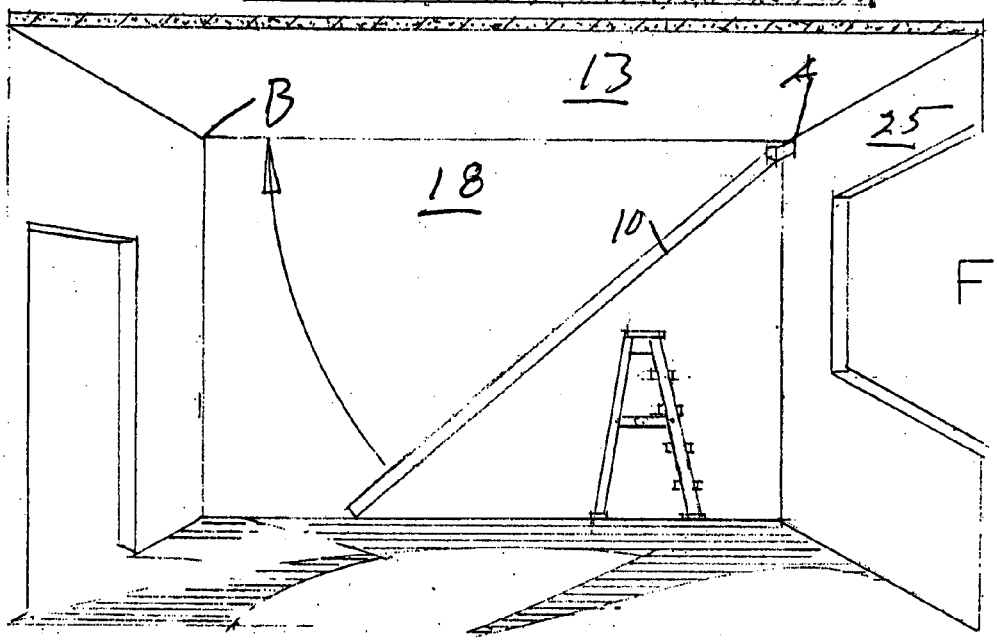
FIG. 11 is a perspective view from inside the room showing the first crown molding piece ready to be nailed to the wall behind.

To start the installation of the crown molding, a worker places a wood block 27 against the room wall 18 a suitable distance down from the ceiling at the location of the first stud (not shown) in this wall from the room corner A. The worker positions the crown molding 10 up against the ceiling 13 in front of block 27 and holds the clamp of the present invention in front of the crown molding, Then the worker hammers a nail N through the present clamp, the crown molding, and the wood block 27 and into the room wall 18 to affix this end of the crown molding to this room wall just below the ceiling. Then the worker moves the clamp from one wall stud to the next and nails it to each stud in succession across wall 18 to complete the installation of this particular crown molding piece. Then the worker proceeds in like manner across the other walls from corners B, C and D, and back to corner A, as indicated by the arrows in FIG. 10.

In FIGS. 1–5 the clamp of the present invention comprises a fixed piece F having vertically elongated, generally flat, rectangular front wall 28 (FIGS. 1 and 3) joined integrally to a rearwardly projecting, horizontal bottom wall 29, a front adjustable piece 31 (FIGS. 2 and 3) positioned directly behind the front wall 28 and slidably adjustable vertically with respect to it, an intermediate adjustable piece 32 directly behind the front adjustable piece 31 and slidably received in the fixed piece F for selective vertical adjustment with respect to the fixed piece and the front adjustable piece 31, a rear adjustable piece 30 slidably received in the fixed piece F directly behind the intermediate adjustable piece 32 and slidably adjustable vertically with respect to the fixed piece F and the other adjustable pieces 31 and 32, and a set screw 33 for securing the rear adjustable piece 30 of the clamp in the position to which it has been adjusted.

As shown in FIG. 1, the fixed piece F of the clamp along the entire vertical length of its front wall 28 has rearwardly projecting flanges 35 and 36 extending rearward from the opposite side edges of the front wall. These flanges have respective inturned rounded lips 37 and 38 on the back (FIG. 2) behind a longitudinal groove or channel 39 in the fixed piece F between its flanges 35 and 36 behind its front wall. Groove 39 snugly but slidably receives the front adjustable piece 31 of the clamp. The fixed piece F has a flat horizontal top face 28' (FIG. 1) at its front wall 28 and flanges 35 and 36.

Near its lower end the fixed piece F is formed with a vertically thick segment 40 which joins its front wall 28 to its rearwardly protruding bottom wall 29. Groove 39 extends down through the connecting segment 40 of the fixed piece F of the clamp, and this connecting segment also presents a vertical rectangular opening 41 immediately behind this groove so that together they define a single opening passing down through connecting segment 40, as best seen in FIG. 2

The front wall 28 of the fixed piece F is formed with three vertically aligned, nail holes 42, 43 and 44. Below the nail holes the front wall 28 carries a forwardly projecting annular boss 45 in which a screw-threaded hole 45*a* is formed (FIG. 5) for threadedly receiving the set screw 33. The set screw-receiving hole 45*a* is vertically aligned with the nail holes 42 and 43 and it opens into the groove 39 and the rectangular opening 41 in the connecting segment 40 of fixed piece F.

Figure 2:
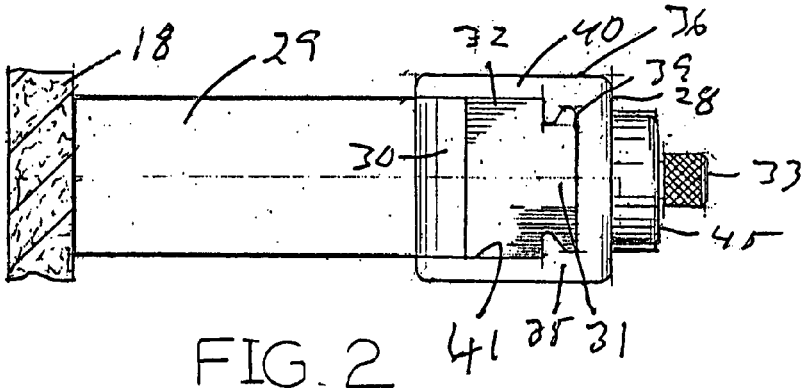
FIG. 2 is a top plan view of the clamp in FIG. 1 with the crown molding omitted for clarity and the room wall behind shown in cross-section.
Figure 5:
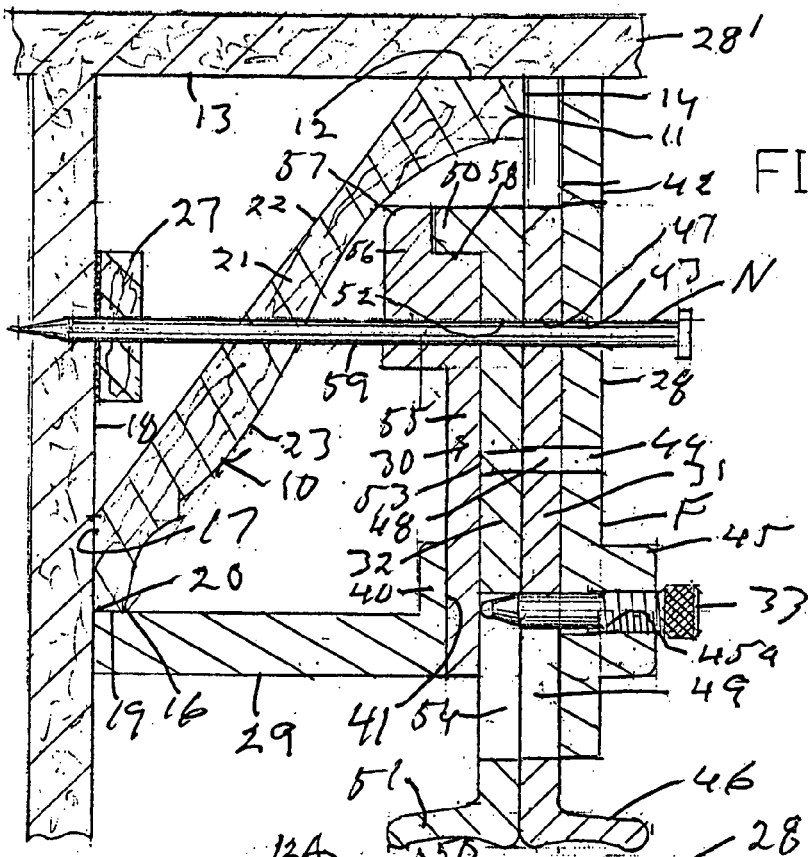
FIG. 5 is a vertical cross-section taken along the line 5—5 in FIG. 1.
Figure 9:
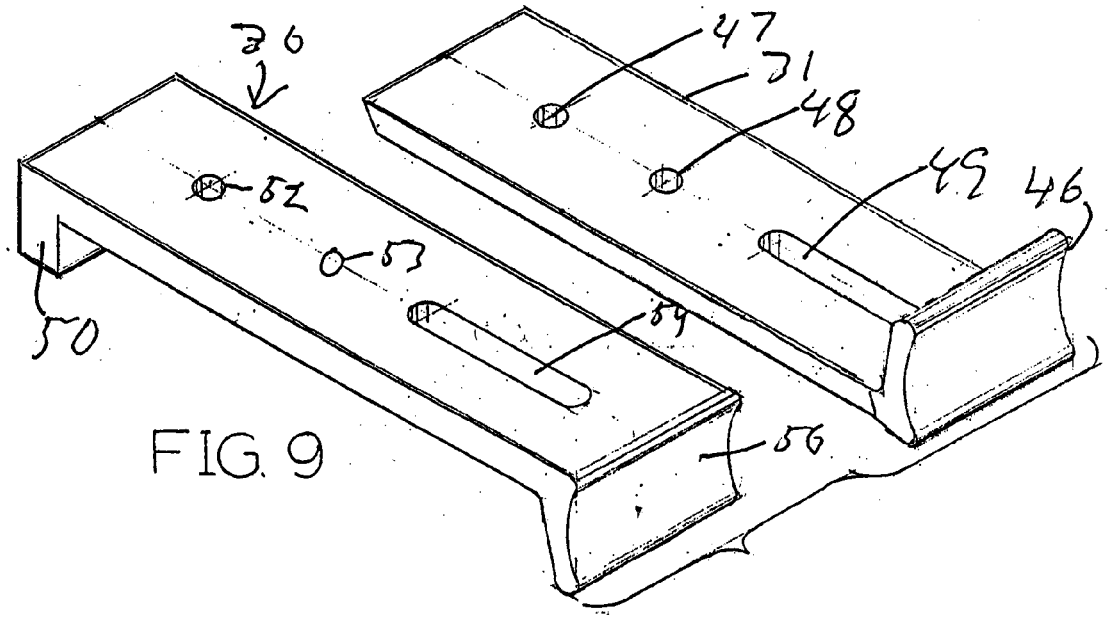
FIG. 9 is an exploded perspective view of two adjustable pieces common to both embodiments of the present clamp.

As shown in FIG. 9, the front adjustable piece 31 of the clamp has the rectangular cross-sectional shape shown in FIG. 2 throughout its vertical extent except for a forwardly projecting horizontal flange 46 on its lower end. The front adjustable piece is snugly but slidably received in the back groove or channel 39 in the fixed piece F of the clamp, including the lower portion of this groove which opens into the rectangular opening 41 behind in the connecting segment 40 of the fixed piece F. The front adjustable piece 31 has a lower nail hole 48 and an upper nail hole 47 which registers with the upper nail hole 42 in the front wall 28 of fixed piece F when the clamp is adjusted for use with a large sized crown molding, as shown in FIG. 5. Also, the front adjustable piece 31 of the clamp has a vertically elongated lower opening 49 which registers with the set screw opening 45*a* in the front wall 28 of fixed piece F in all the vertical positions to which the front adjustable piece 31 of the clamp may be adjusted behind the fixed piece F.

The intermediate adjustable piece 32 of the clamp (FIG. 9) is flat and rectangular throughout except for a rearwardly projecting horizontal flange 50 at its upper end (FIGS. 1 and 5) and a rearwardly projecting horizontal flange 51 at its lower end. Piece 32 is slidably received in the vertical opening 41 in the fixed piece F immediately behind the front adjustable piece 31. It has an upper nail hole 52 which registers with the upper nail hole 47 in the front adjustable piece 31 in the position of the parts shown in FIG. 5, as well as a lower nail hole 53 and, below it, a vertically elongated opening 54 registering with the similar opening 49 in the front adjustable piece 31 in all the positions to which the intermediate adjustable piece is vertically adjusted with respect to the fixed piece F and the front adjustable piece 31.

The rear adjustable piece 30 (FIG. 5) has a flat, rectangular, vertical, lower wall 55 which is positioned directly behind the intermediate adjustable piece 32 and is slidably received in the opening 41 in the fixed piece F. At its upper end the rear adjustable piece 30 has a rearwardly projecting enlargement 56 with a rounded upper back corner 57 and a rectangular open-topped recess 58 on the front in which the upper end flange 50 of the intermediate adjustable piece 32 can seat, as shown in FIG. 3. A nail hole 59 extends horizontally through the enlargement 56 from front to back. Nail hole 59 registers with the upper nail hole 52 in the intermediate adjustable piece 32, the upper nail hole 47 in the front adjustable piece 31, and the intermediate nail hole 43 in the fixed piece F when the clamp is adjusted to the position shown in FIG. 5. Alternatively, when the clamp is adjusted to the position shown in FIG. 6, nail hole 59 in the rear adjustable piece 30 registers with the lower nail hole 53 in the intermediate adjustable piece 32, the upper nail hole 47 in the front adjustable piece 31, and the middle nail hole 43 in the fixed piece F of the clamp When used with a large sized crown molding 10, as shown in FIG. 5, the clamp of the present invention has its fixed piece F positioned with its top face 28' engaging the ceiling 13 and its flanges 35 and 36 engaging the front face 14 of the top front lip 11 of the crown molding, and its bottom wall 29 abutting against the room wall 18 behind and engaging from below the bottom face 19 of the bottom rear lip 16 of the crown molding. The set screw 30 forces the rear adjustable piece 30 back against the back wall of the opening 41 in the enlarged connecting portion 40 of the fixed piece to hold it in the position shown in FIGS. 1 and 5. The front adjustable piece 31 is slid vertically along the fixed piece F to a position in which its upper nail hole 47 is aligned with the middle nail hole 43 in the fixed piece F. The intermediate adjustable piece 32 is slid vertically to a position in which its top flange 50 is seated in the top front recess 58 of the rear adjustable piece 30, its upper nail hole 52 registers with the nail hole 59 in the rear adjustable piece 30, with the upper nail hole 47 in the front adjustable piece 31, and with the middle nail hole 43 in the fixed piece F. The nail N may be inserted through these aligned holes in the clamp and driven through the crown molding 10 and the wood block 27 behind into the wall stud in room wall 18. The nail N holds the front adjustable piece 31 and the intermediate adjustable piece 32 in the clamp in the positions to which they have been adjusted.

Figure 6:
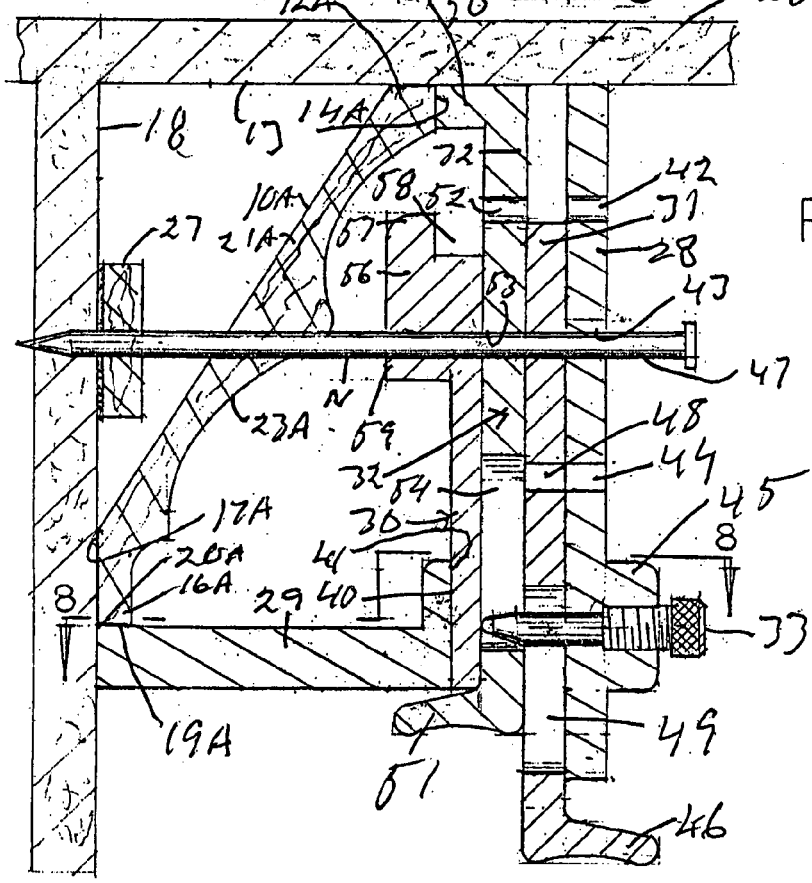
FIG. 6 is a view similar to FIG. 5 and showing the clamp adjusted for use with a slightly smaller crown molding.

The same clamp may be used with a somewhat smaller crown molding 10A (FIG. 6), elements of which are given the same references numerals, with an A suffix added, as those of the crown molding 10 in FIG. 3. In FIG. 6 the fixed piece F, the front adjustable piece 31 and the rear adjustable piece 30 are positioned the same as in FIG. 5, but the intermediate adjustable piece 32 is raised to align its middle nail hole 53 with the middle nail hole 43 in the fixed piece F, with the upper nail hole 47 in the front adjustable piece 31, and with the nail hole 59 in the rear adjustable piece 30. Nail N is driven through these aligned holes in the clamp, through the crown molding 10A and wood block 27, and into the stud in the room wall 18 behind. The bottom wall 29 of the fixed piece F engages the room wall 18 and engages the lower rear lip 16A of the crown molding from below. The top flange 50 of the intermediate adjustable piece 32 engages the ceiling 13 and engages the front face 14A of the top front lip of the crown molding.

Figure 7:
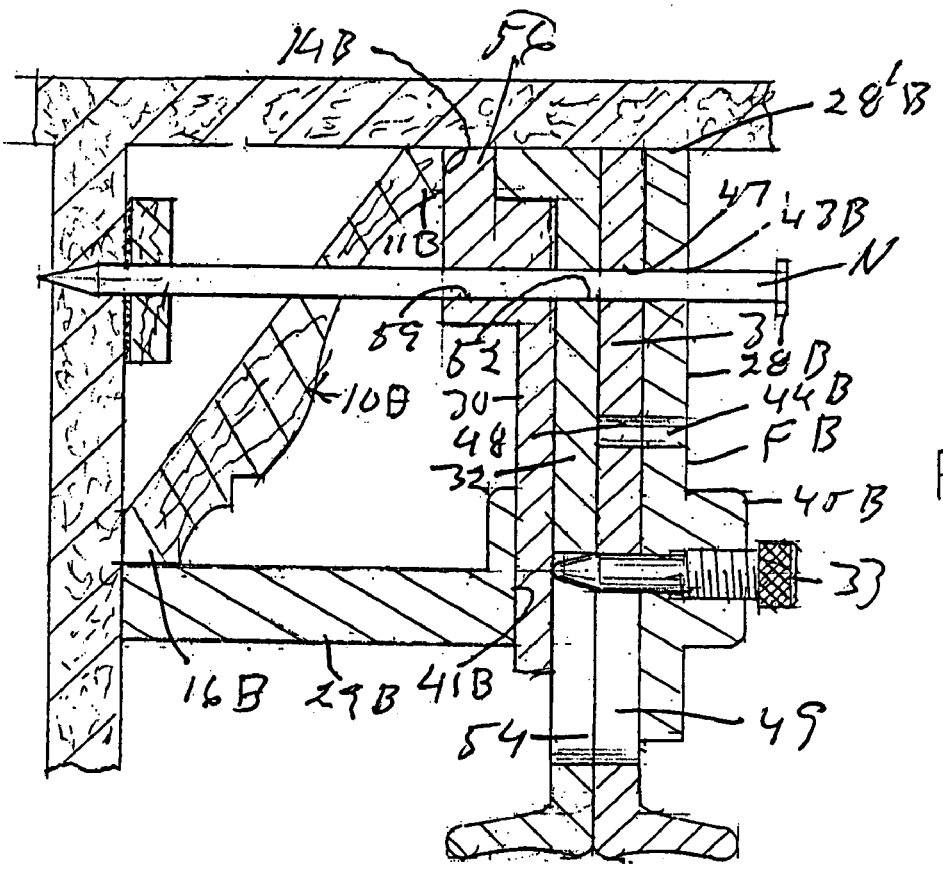
FIG. 7 is a view similar to FIGS. 5 and 6 and showing a second embodiment of the present clamp for use with an even smaller crown molding.
Figure 8:
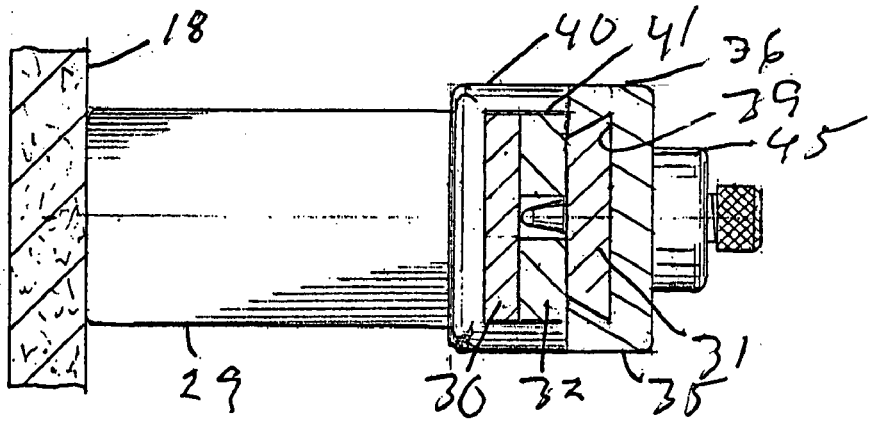
FIG. 8 is a horizontal section taken along the line 8—8 in FIG. 6.

FIG. 7 shows a modified clamp in accordance with the present invention for use with an even smaller crown molding 10 B than the molding 10 in FIGS. 1–4 or the molding 10A in FIG. 5. Features of this crown molding which correspond to the elements of the larger crown molding 10 in FIGS. 1–4 are given the same reference numerals with a B suffix added. The adjustable pieces 30, 31 and 32 of this clamp are the same as those in FIGS. 1–6 but the fixed piece FB of this clamp is different in that its front wall 28B is shorter and the top nail hole (42 in FIGS. 5 and 6) is omotted.

Because of this change, the nail opening 43B in the fixed piece of the clamp registers with the upper nail opening 47 in the front adjustable piece 31, the upper nail opening 52 in the intermediate adjustable piece 32, and the nail opening 59 in the rear adjustable piece 30 when all three adjustable pieces are raised along the fixed piece to engage the ceiling 13. In this position of the parts, the bottom wall 29B of the fixed piece engages the lower rear lip 16 B of the crown molding from below, as well as engaging the room wall 18. The upper end enlargement 56 of the rear adjustable piece 30 engages the front face 14B of the top front lip 11B of the crown molding 10B.

From the foregoing description, taken in conjunction with the accompanying drawings, it will be understood that the present clamp makes it easier and more convenient for a worker, without assistance, to nail crown of various sizes and shapes in place. Also, it will be understood that various adjustments of the present clamp other than the ones illustrated may be made to accommodate it to various sizes and shapes of crown molding.

I claim:

1. A crown molding clamp for use with crown molding having a top front lip, a bottom rear lip, and a bridging segment extending diagonally up and forward from said bottom rear lip to said top front lip, said clamp comprising:

a fixed piece with a vertical front wall having a top face for engaging the ceiling of a room and an upper rear face extending down from said top face and facing said top front lip of the crown molding, said front wall of the fixed piece having a plurality of vertically space nail holes therein, said fixed piece also having a horizontal bottom wall extending rearward from said front wall for engagement with the room wall behind and for engagement with said bottom rear lip of the crown molding from below;

a front adjustable piece slidably mounted on the back of said front wall of the fixed piece for vertical adjustment with respect to said fixed piece, said front adjustable piece having a nail hole therein which is selectively registrable with one of said nail holes in the front wall of the fixed piece;

an intermediate adjustable piece directly behind said front adjustable piece and slidably adjustable vertically with respect to said front adjustable piece and said front wall of the fixed piece, said intermediate adjustable piece having a pair of vertically spaced nail holes for individual registration selectively with said nail holes in said front wall of the fixed piece and said front adjustable piece, said intermediate adjustable piece having a top face for selective engagement with the ceiling and a rear upper end face extending down from said top face for selective engagement with the top front lip of the crown molding;

a rear adjustable piece directly behind said intermediate adjustable piece and slidably adjustable vertically with respect to said intermediate adjustable piece and said front adjustable piece, said rear adjustable piece having a nail opening therein for registration selectively with said nail holes in said front wall of the fixed piece, said front adjustable piece and said intermediate adjustable piece, said rear adjustable piece having a top face for selective engagement with the ceiling and a rear upper end face extending down from said top face for selective engagement with the top front lip of the crown molding;

and means for selectively holding said adjustable pieces at selected vertical positions behind said front wall of said fixed piece.

2. A clamp according to claim 1, wherein said upper rear face of the fixed piece is exposed and positioned for engagement with said top front lip of the crown molding when said adjustable pieces are in lowered positions behind said front wall of the fixed piece.

3. A clamp according to claim 2, wherein said upper rear face of the intermediate adjustable piece is exposed and positioned for engagement with said top front lip of the crown molding when said intermediate adjustable piece is in a raised position behind said front wall of the fixed piece and said rear adjustable piece is in a lowered position behind said front wall of the fixed piece.

4. A clamp according to claim 2, wherein said upper rear face of the rear adjustable piece is exposed and positioned for engagement with said top front lip of the crown molding when said front and intermediate adjustable pieces are in raised positions behind said front wall of the fixed piece.

5. A clamp according to claim 1, wherein said upper rear face of the intermediate adjustable piece is exposed and positioned for engagement with said top front lip of the crown molding when said intermediate adjustable piece is in a raised position behind said front wall of the fixed piece.

6. A clamp according to claim 1, wherein said upper rear face of the rear adjustable piece is exposed and positioned for engagement with said top front lip of the crown molding when said front and intermediate adjustable pieces are in raised positions behind said front wall of the fixed piece.

7. A crown molding clamp for use with crown molding having a top front lip, a bottom rear lip, and a bridging segment extending diagonally up and forward from said bottom rear lip to said top front lip, said clamp comprising: a vertical front wall having a top face for engaging the ceiling of a room and an upper rear face extending down from said top face for engagement with said top front lip of the crown molding from in front, said front wall having at least one nail hole therein, and a horizontal bottom wall extending rearward from said front wall for engagement with the room wall behind and for engagement with said bottom rear lip of the crown molding from below.

* * * * *